United States Patent [19]

Clerk

[11] 3,941,032

[45] Mar. 2, 1976

[54] PISTON PUMPS OR MOTORS

[76] Inventor: Robert Cecil Clerk, Edison House, Fullerton Road, Queensway Industrial Estate, Glenrothes, Fife, Scotland

[22] Filed: June 24, 1974

[21] Appl. No.: 482,084

[30] Foreign Application Priority Data

June 22, 1973 United Kingdom ..... 29690/73
June 14, 1974 United Kingdom ..... 29690/74

[52] U.S. Cl. ..... 91/6.5; 138/30
[51] Int. Cl.[2] ..... F01B 3/00; F16L 55/04
[58] Field of Search ..... 91/6.5, 504; 138/30

[56] References Cited

UNITED STATES PATENTS

| | | | |
|---|---|---|---|
| 2,351,761 | 6/1944 | Hanna | 138/30 |
| 2,968,319 | 1/1961 | Ball | 138/30 |
| 3,003,522 | 10/1961 | Rohacs | 138/30 |
| 3,199,461 | 8/1965 | Wolf | 91/6.5 |
| 3,858,483 | 1/1975 | Hein | 91/6.5 |

*Primary Examiner*—William L. Freeh
*Assistant Examiner*—G. P. LaPointe

[57] ABSTRACT

The invention provides a capsule for damping pressure pulses in the working fluid of piston pumps and motors, the capsule being formed with co-axial inner and outer pervious walls which serve to limit the contraction and expansion of a flexible gas-filled bag enclosed between them.

5 Claims, 3 Drawing Figures

PISTON PUMPS OR MOTORS

This invention relates to improvements in piston pumps and motors, and in particular to ported rotary barrel axial piston pumps, which have an inherent volumetric (delivery or induction) variation in the working fluid due to the superimposition of the harmonic volumetric variation of consecutive pumping cylinders.

This combined volumetric variation is of little consequence in a hydraulic system which is highly elastic whether due to the compressibility of a volume of fluid which is large in relation to the harmonic pumping differential, or to 'give' in the piping and other pressure containments, provided also that the frequency is low in relation to the pumping differential.

Where the circuit volume is small and/or where there is negligible 'give' in the containments and/or where the frequency is high, this is widened by a variation of angular rotation (and therefore angular accelerations) of the pump or motor, and/or by a pulsating variation in the system pressure the magnitude of which is limited only by the modulus of elasticity of the fluid and containments, or be relieving a large part of the pumping differential.

It is well known to obtain some reduction in the magnitude of this pressure pulsation by introducing an artificial elasticity or 'give' into the circuit in the form of an air pocket or a bladder type-hydropneumatic accumulator, but this is subject to a return lag at high frequencies, which causes choking of the communicating tract. A better alternative is an in-line annular accumulator surrounding one of the main delivery pipes which is perforated in the appropriate area, and this is effective at medium pressures and frequencies but only down-stream of the annular element as regards flow variation, which on the pump side is still subject to accelerative pulsations.

The object of the present invention is to provide a means by which the volumetric pumping differential is accommodated within the pump port or port gallery so that the flow external of the pump is smooth and subject only to a pressure variation which is negligible at critical high pressures and frequencies.

A further object of the present invention is that this means should also be effective in controlling intake pulsations which because they are at sub-atomospheric pressures are invariably neglected due to lack of recognition as a major cause of suction cavitations.

To this end what I propose is a rotary barrel axial, piston pump/motor incorporating an otherwise sealed chamber communicating directly with a port-gallery of a port face of the pump/motor by at least one opening so as to induce a change of fluid content in the chamber, the said chamber containing a capsule characterised by its having pervious high-tensile outer and inner physical containments for a lightweight gas-containing flexible bladder intermediate of the containments which serve as the limiting boundaries of expansion and contraction of the bladder, supporting it against pressure differentials which will occur when the bladder is at the limit of containment, whether due to exterior hydraulic pressure holding it against the inner containment or interior gas pressure holding it against the outer containment.

The capsule can be either free floating in the sealed chamber, a predetermined volume of gas having been injected and sealed into the bladder at assembly of the capsule, or the capsule may be formed as an inwards projection of a chamber sealing plug which carries a gas injection orifice fitted either with a non-return filling valve or a "permanent" seal.

The capsule is of such dimensions relative to the chamber that, for the high pressure applications at least, the clearance of the capsule outer containment within the chamber is less than the strain extension of the containment when there is an excess imbalance of pressure of the contained gas relative to the surrounding chamber fluid, the chamber inner surface having multiple grooves or interconnecting depressions cast, coined, or otherwise formed in bas-relief.

For low-pressure delivery applications the outer containment of the discrete capsule can be constituted by bas-relieved inner surface of the chamber the bas-relief grooves the grooves of which render its portions in the sense that external fluid pressure can communicate effectively with substantially all of the outer surface of the bladder.

In application, to fit conveniently within the pump head, the chamber and capsule may be restricted in volume, a representative figure being fifteen times the harmonic pumping differential volume or periodic variation of instantaneous delivery port flow. The volume enclosed by the inner perforate containment may conveniently be three-fifths of the effective or internal fluid flow of the volume.

Exemplary forms of pulsation damping capsules and their containments are illustrated in the accompanying drawings, in which.

Figure 1:
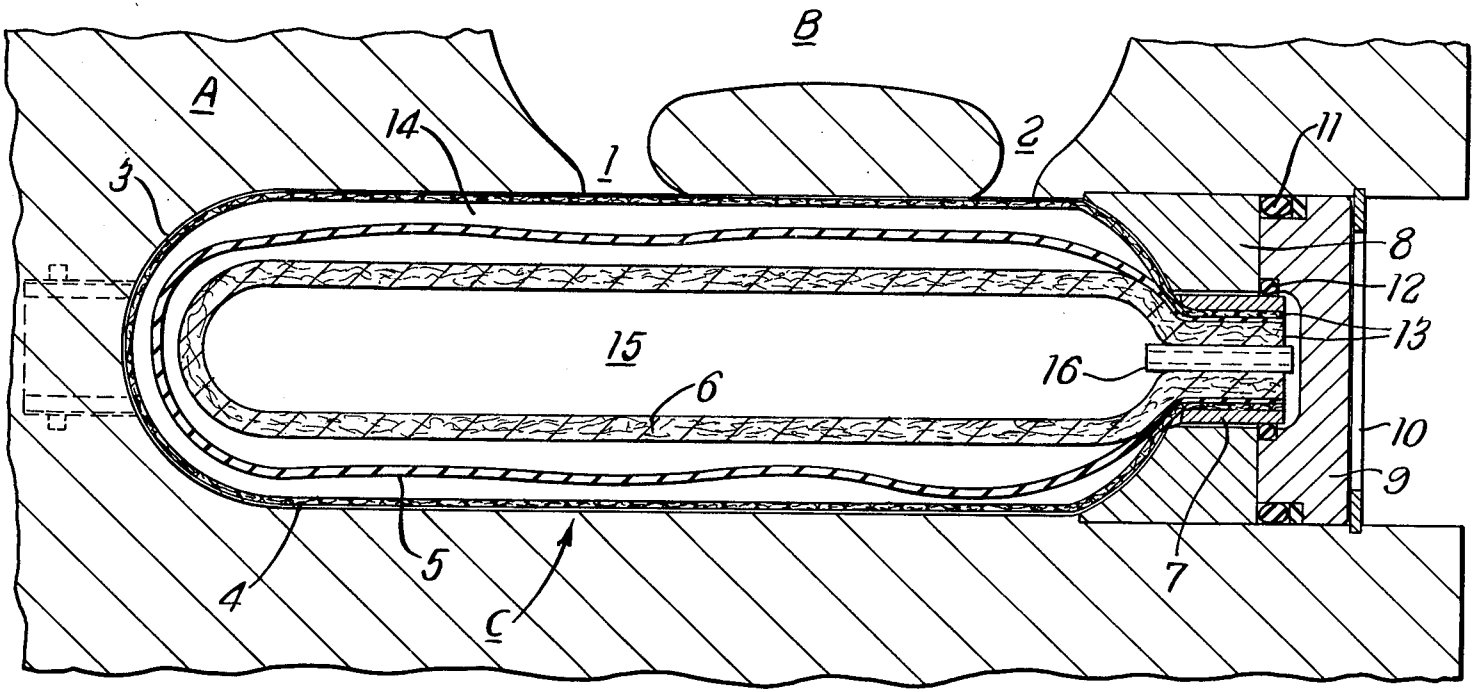
FIG. 1 is a central vertical section through a pump port face and port gallery of the intake side of an axial piston pump showing a containment chamber and one form of capsule.

In FIG. 1 A represents a pump port face gallery and B represents an inlet port therein divided into two passages 1 and 2.

A cylindrical chamber with a domed end 3 is formed to span the port B and contain a capsule C.

The capsule C comprises a light gauge outer porous wall 4, an intermediate flexible bag 5 filled with gas at predetermined pressure and an inner porous wall 6 of heavier gauge porous material.

The inner and outer walls and bag are clamped together by means of a compression sleeve 7, filler block 8 sealing plug 9 and circlip 10, as shown at the right hand side of the drawing, in conjunction with O-rings 11 and 12.

Since the neck portions 13 of the walls 4 and 6 are porous and could provide a leak path, they are filled with a sealant setting compound.

The whole of the space 14 exterior of the bag 5 is filled with pump working fluid (normally vacuum-stripped oil) and the whole of the space 15 within the bag 5 and inner porous wall 6 is filled with gas, which is introduced initially through injection tube 16 which is subsequently sealed off.

As indicated in broken lines at the left hand side of the drawing it is possible to duplicate the sealing arrangement of the right hand side at this side of the chamber.

In this case the walls 4 and 6 and the bag 5 may be tubular rather than close-ended.

Figure 2:
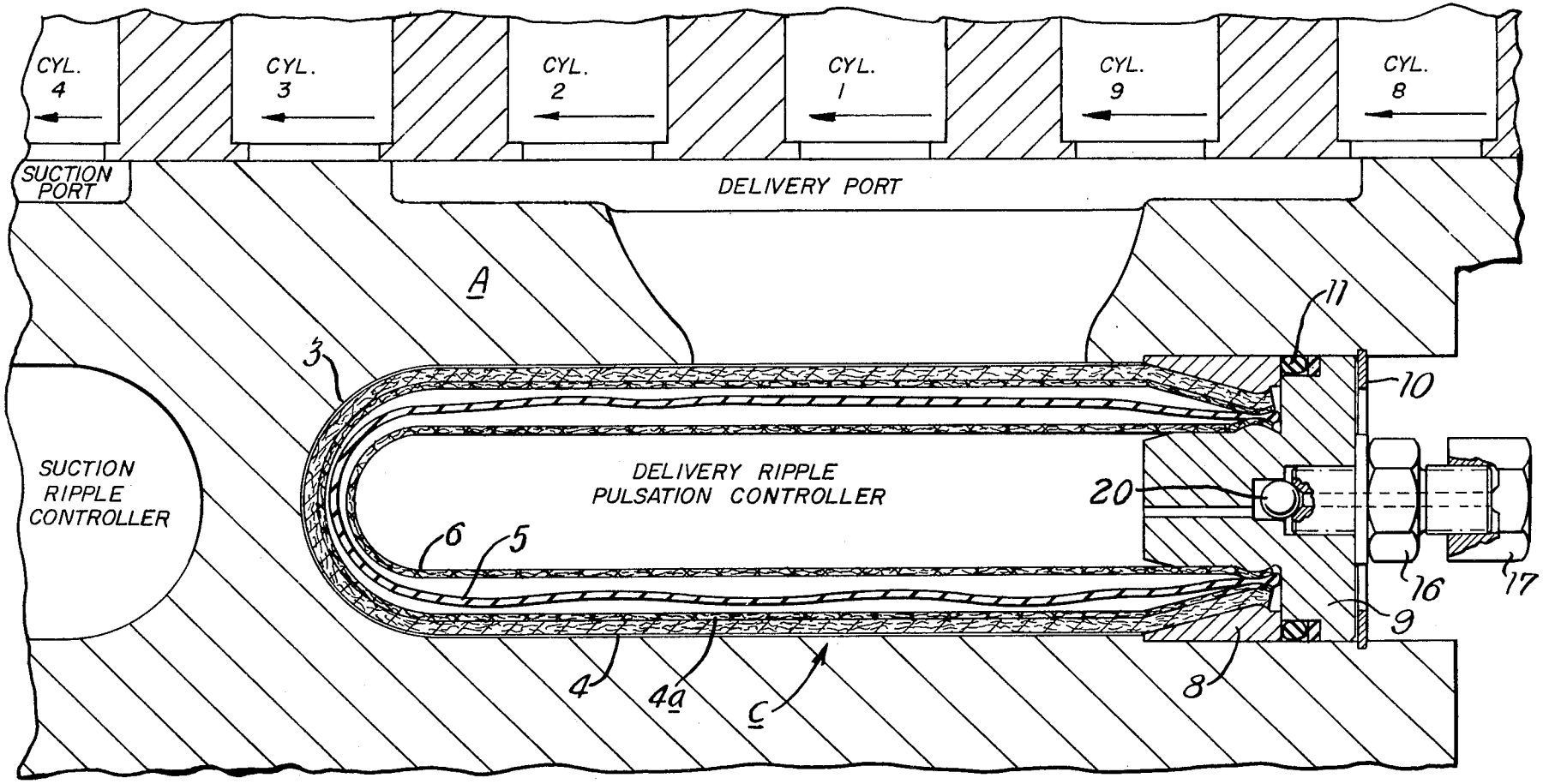
FIG. 2 is a similar view of the containment and one form of capsule suitable for the delivery side of a pump.

In FIG. 2 like references as in FIG. 1 are used where appropriate.

The pump port face gallery A in this drawing includes a delivery port D.

The outer wall 4 is of heavy gauge and duplexed by an inner skin 4*a*, while the inner wall 6 is of lighter gauge porous material.

The sealing plug 9 in this form of capsule includes a ball check valve 20, a charging connector 16 and a closure gap 17.

This type of capsule can have the bag 5 charged with gas to any desired pressure after filment in the pump.

Figure 3:
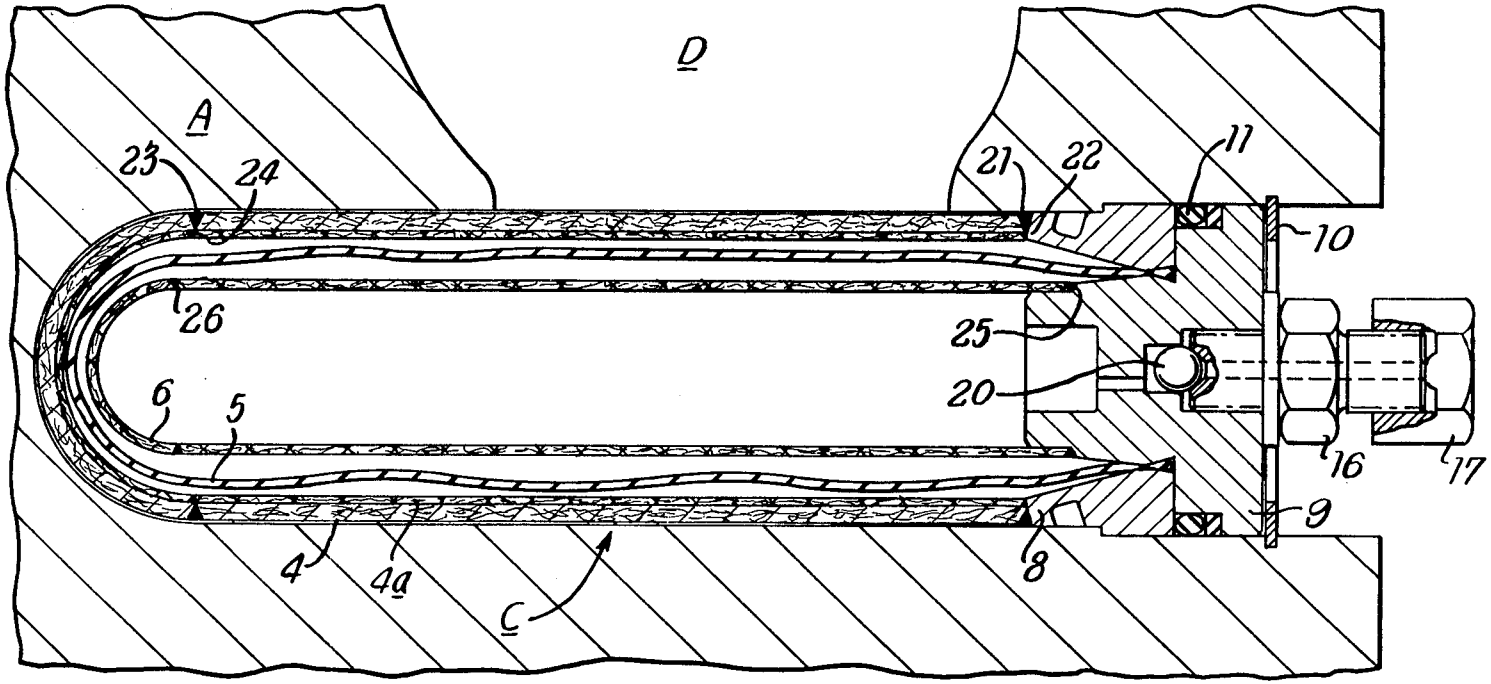
FIG. 3 is a similar view of that of FIG. 2 showing an alternative form of capsule.

The capsule of FIG. 3 has the same charging facility as that of FIG. 2, but construction and sealing problems are eased by the use of welds at junctions 21 to 26 where shown.

I claim:

1. In a multi-cylinder, reciprocating position type fluid pressure energy translating device in which there is relative movement between a cylinder block and a fluid handling section which defines internal, spaced, low and high pressure ducts, and in which such relative movement successively brings open ends of the piston chambers in the cylinder block into alternate open communication with the low and the high pressure ducts in the fluid handling section, and in which piston reciprocation and the relative movement between the cylinder block and said fluid handling section is timed so that each piston travels on at least a portion of its compression stroke between the time its chamber breaks communication with said low pressure duct and the time its chamber begins direct communication with said high pressure duct, pressure regulating structure for leveling pulsations in the high pressure duct including a ripple control capsule disposed in a chamber in communication with and only in communication with the high pressure duct, said capsule comprising a pair of spaced inner and outer porous wall members and a flexible, impermeable bag-like member disposed between said inner and outer wall members such that movement of said bag-like member is restricted by said inner and outer wall members, means for sealing the space within the bag-like member from the space outside of the bag-like member, and means for introducing fluid under pressure into said bag-like member, and wherein said capsule is so disposed in communication with the high pressure duct that the pressure in the high pressure duct is in communication with the space outside of said bag-like member such that pulsations in the high pressure duct are reduced.

2. A pressure regulating structure according to claim 1, wherein the said capsule is formed as an inward projection of a chamber sealing plug.

3. A pressure regulating structure according to claim 1, wherein the said plug includes a non-return check valve for introduction of the pressurizing gas.

4. A pressure regulating structure according to claim 1, wherein the said chamber has a volume about fifteen times that of the harmonic pumping differential volume of the said device.

5. A pressure regulating structure according to claim 1, wherein the volume enclosed by the said inner wall member is about three-fifths of the total enclosed volume of the said chamber.

* * * * *